US006461282B1

(12) United States Patent
Fenelon

(10) Patent No.: US 6,461,282 B1
(45) Date of Patent: Oct. 8, 2002

(54) DUMBBELL SYSTEM

(76) Inventor: Paul J. Fenelon, 13 Inverary, Nashville, TN (US) 37215

( * ) Notice: Subject to any disclaimer, the term of this patent is extended or adjusted under 35 U.S.C. 154(b) by 0 days.

(21) Appl. No.: 09/501,392

(22) Filed: Feb. 9, 2000

(51) Int. Cl.[7] ..... A63B 21/072
(52) U.S. Cl. ..... 482/106; 482/107; 482/108
(58) Field of Search ..... 482/92, 93, 106, 482/107, 108, 109; D21/680–683

(56) References Cited

U.S. PATENT DOCUMENTS

| | | | | |
|---|---|---|---|---|
| 660,962 | A | | 10/1900 | Kennedy |
| D200,053 | S | | 1/1965 | Edwards |
| D244,628 | S | | 6/1977 | Wright |
| 4,029,312 | A | | 6/1977 | Wright |
| D271,407 | S | | 11/1983 | Wright |
| D274,283 | S | | 6/1984 | Wright |
| D302,195 | S | | 7/1989 | Orak |
| 4,854,757 | A | | 8/1989 | Wilson et al. |
| 4,900,017 | A | * | 2/1990 | Bold, Jr. ..... 482/132 |
| D307,168 | S | | 4/1990 | Vodhanel |
| D343,660 | S | | 1/1994 | Hwang |
| 5,421,797 | A | | 6/1995 | Fletcher |
| D372,945 | S | | 8/1996 | Morgan |
| 5,607,379 | A | * | 3/1997 | Scott ..... 482/107 |
| 5,637,064 | A | | 6/1997 | Olson et al. |
| 5,779,604 | A | | 7/1998 | Towley, III et al. |
| 6,083,144 | A | | 7/2000 | Towely, III et al. |

OTHER PUBLICATIONS

*Body Online Trends*, ProBell "Adjustable Dumbbell System" (website http://www.bodytrends.com/pbl.htm) (27 pages).
*Powerblock*, "World's Best Dumbbell!" (2 pages).

* cited by examiner

*Primary Examiner*—Stephen R. Crow
(74) *Attorney, Agent, or Firm*—Harness, Dickey & Pierce, P.L.C.

(57) ABSTRACT

A dumbbell system is provided including a base weight member having a ring-shaped body and a handle extending across an opening in the ring-shaped body. A plurality of weight rings are adapted to be removably mounted to the base weight member in order to provide a compact dumbbell system which has the capability of providing several weight increments in a compact assembly. The dumbbell system is ideal for use in areas where space is limited. The dumbbell also provides for a unique balanced mass arrangement which alleviates undesired stresses on a user's wrist.

29 Claims, 6 Drawing Sheets

FIG 1
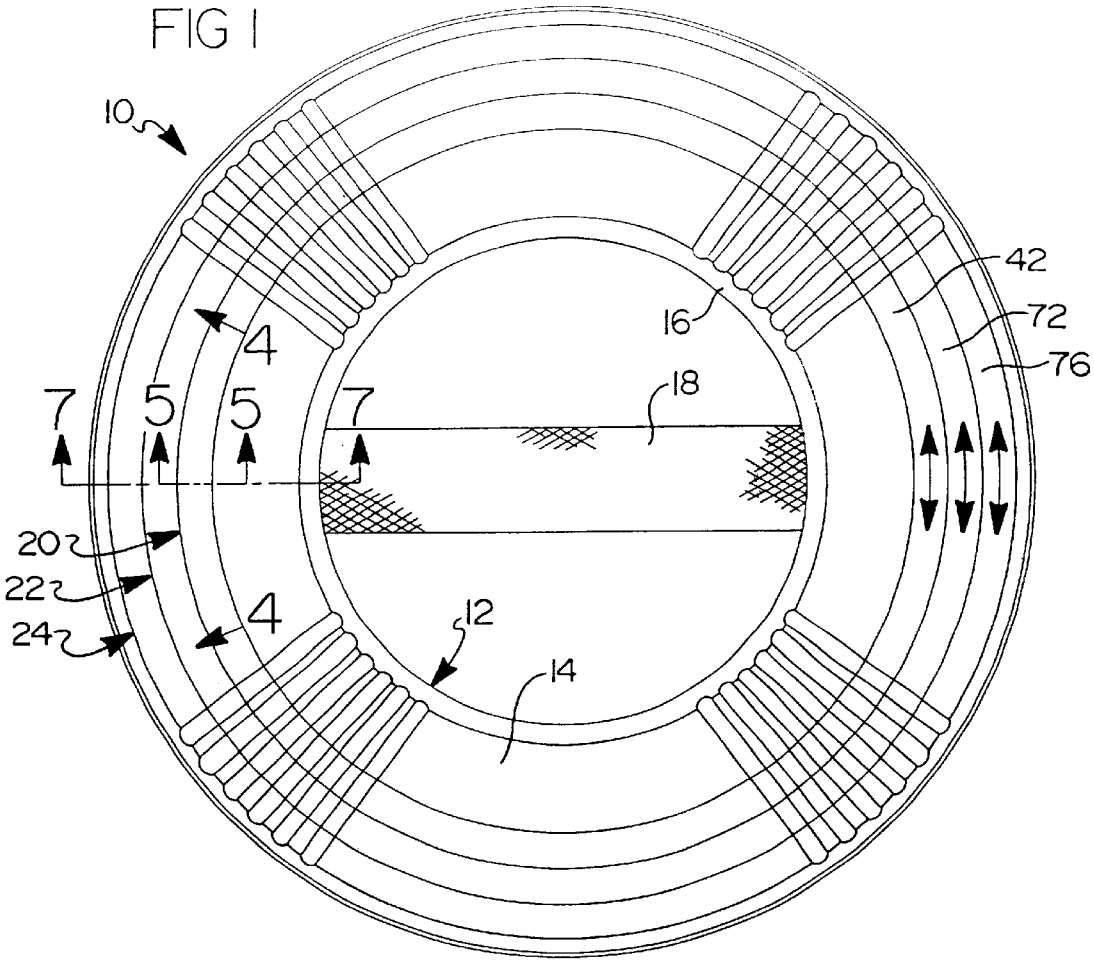
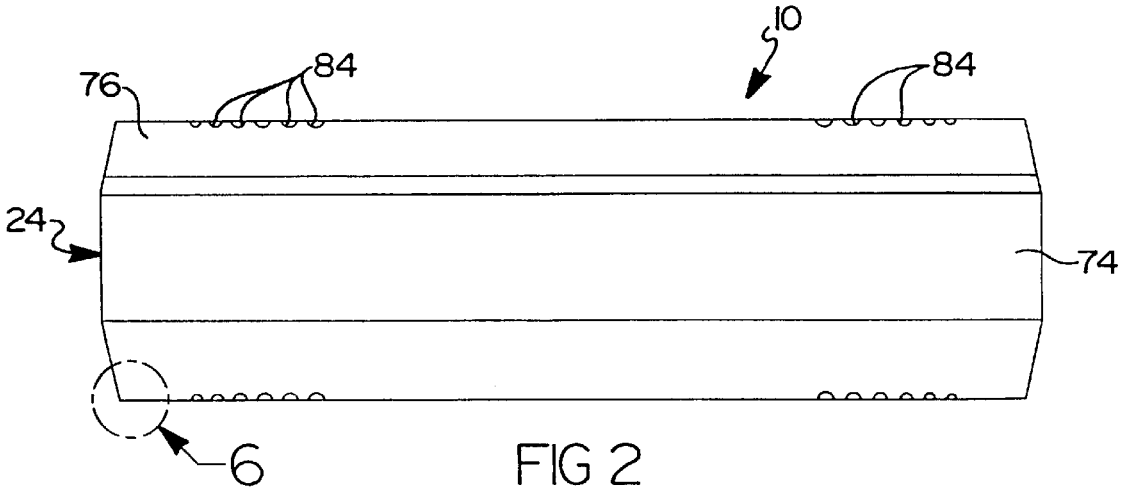
FIG 2

FIG 7
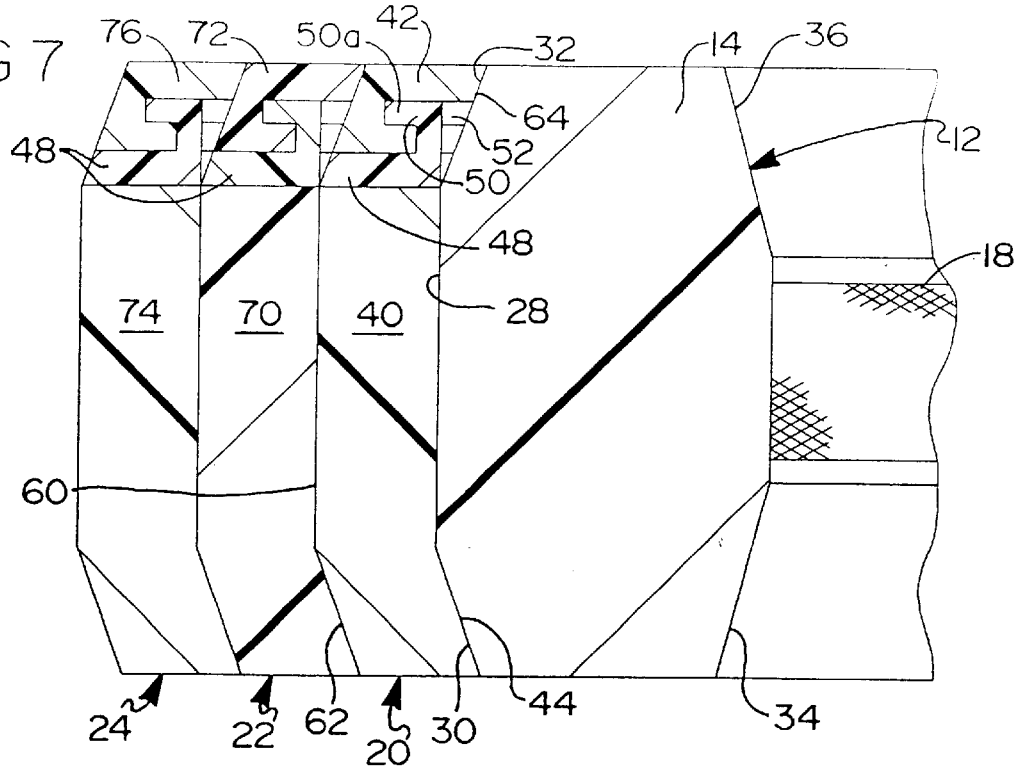
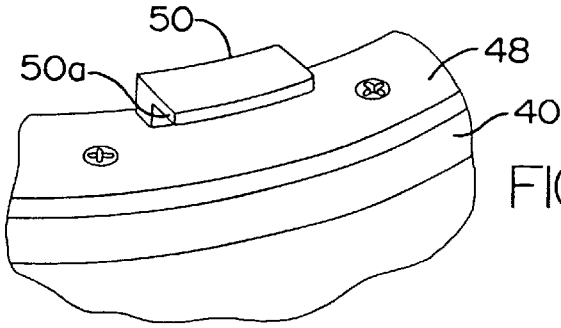
FIG 9
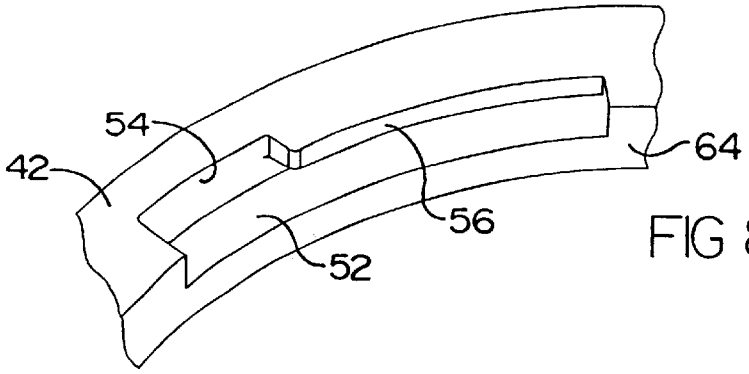
FIG 8

DUMBBELL SYSTEM

FIELD OF THE INVENTION

The present invention relates generally to dumbbells for weight lifting, and more particularly to a dumbbell system with improved ergonomic design and which allows for the simple addition of additional weights to a base dumbbell member in a compact design.

BACKGROUND

Studies have shown that exercise greatly reduces the risk of heart disease and other ailments, and also contributes to better overall health and well being. Weight lifting has been determined to be a very important part of a well balanced exercise regimen. Accordingly, people are joining health clubs and purchasing home gym equipment in order to improve their physical fitness.

Health clubs typically have several racks of non-stackable dumbbells of varying weight which range from five pounds to approximately 120 pounds in five-pound or similar increments. The racks to hold all of the dumbbells in the five-pound to 120-pound sets are typically several feet long. Because such sets of dumbbells are extremely expensive and consume a lot of space, these sets are not well designed for home use.

Dumbbells have been designed for home gym use to include a bar having a center sleeve portion which defines a handle and weight discs which are removably attached to each end of the bar by a locking collar. A problem with these prior art designs is that it is still necessary to maintain a full set of disc weights which can be placed on the ends of the dumbbell bar. Furthermore, it is time consuming to put the weights on and take the weights off from this type of dumbbell design. The locking collars are also a safety hazard if they are not properly secured in place. In addition, with the weights being disposed at each end of the dumbbell, the moment arm which is applied to a user's wrist if the dumbbell is not maintained in a horizontal plane can result in painful stresses to the wrist joint of the user. Similar painful stresses are present with standard one-piece dumbbells.

SUMMARY OF THE INVENTION

Accordingly, it is an object of the present invention to provide a dumbbell system which is capable of providing several increments of weight in a compact construction.

It is another object of the present invention to provide a dumbbell system which provides equally distributed weight around the handle of the dumbbell assembly so that rotation of the handle away from a horizontal position does not result in undesirable added stresses on the user's wrist.

These and other objects of the present invention are obtained by providing a dumbbell system including a base weight member including a ring shaped body and a handle extending across an opening in the ring shaped body. A weight ring is adapted to be removably mounted to the base weight member. A lock ring is engagable with the weight ring to securely mount the weight ring to the base weight member. The weight ring includes a first mating portion, and the lock ring includes a second mating portion which is adapted to be engaged with the first mating portion of the weight ring for securing the weight ring to the lock ring. The base weight member has an outer perimeter surface with a pair of angularly disposed edge portions while the weight ring includes an inner surface with at least one angularly disposed edge portion which engages one of the pair of angularly disposed edge portions of the base weight member. The locking ring includes an angularly disposed inner surface which engages the other of the pair of angularly disposed edge portions of the base weight member.

A series of additional weight rings are adapted to be removably mounted to one another in order to provide variable increments of weight. The base weight member as well as the additional weight rings can be nested together in a single assembly and the lock rings can be selectively engaged or disengaged from the weight rings in order to allow the user to select from a plurality of weight increments. The lock rings can be provided with a plurality of dimples on a face surface thereof in order to facilitate rotation of the lock ring relative to the corresponding weight ring so that the lock ring can be easily engaged or disengaged from the weight ring.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 1 is a top view of a dumbbell assembly according to the principles of the present invention;

FIG. 2 is a side view of the dumbbell assembly shown in FIG. 1;

FIG. 7 is a cross-sectional view along line 7—7 of FIG. 1;

FIG. 8 is a detailed perspective view of the slot provided in the lock rings according to the principles of the present invention;

FIG. 9 is a detailed perspective view of the locking tabs which are engagable with the slot in the lock ring;

DETAILED DESCRIPTION OF THE PREFERRED EMBODIMENTS

Figure 3:
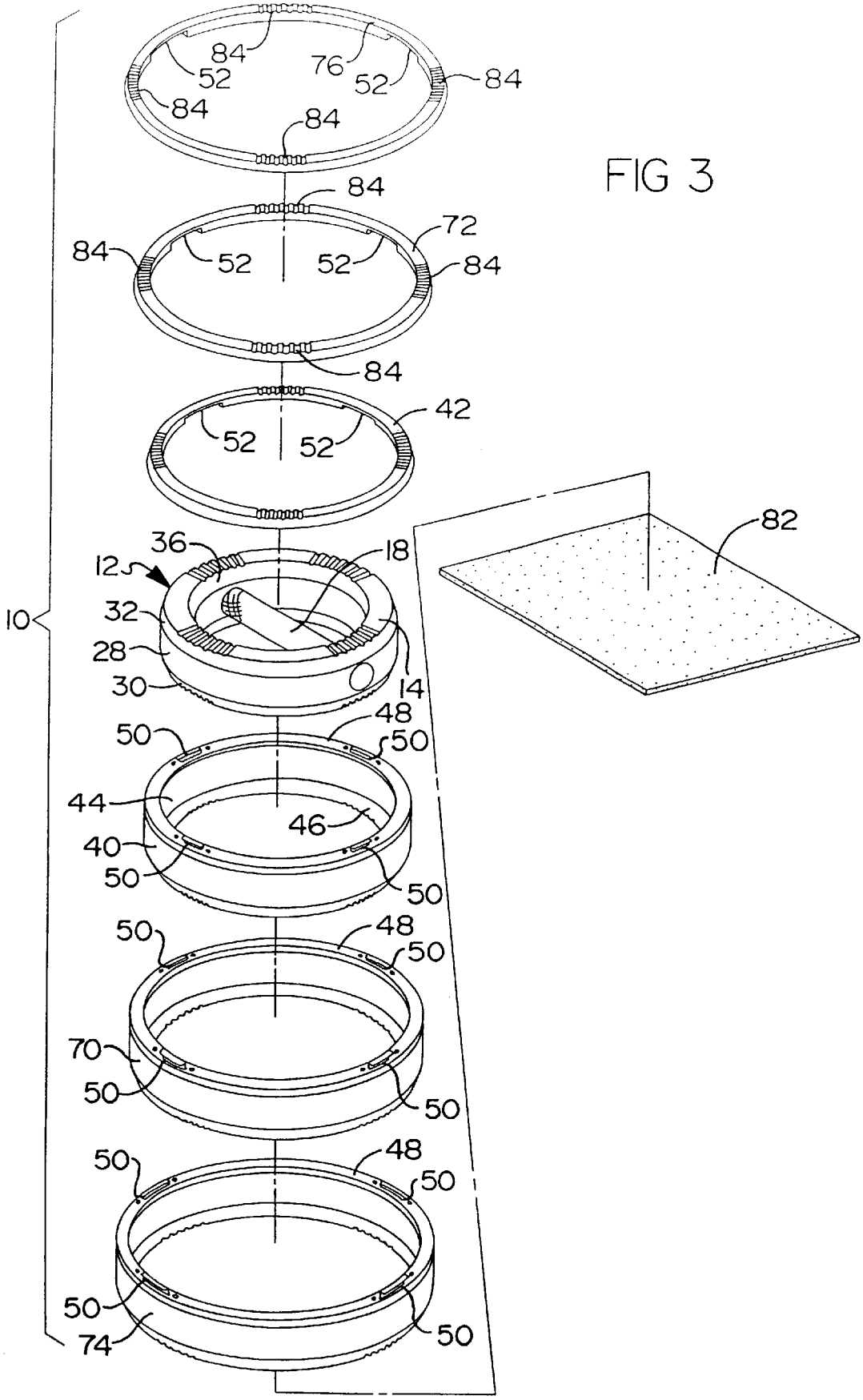
FIG. 3 is an exploded perspective view of the dumbbell assembly according to the principles of the present invention.
Figure 4:
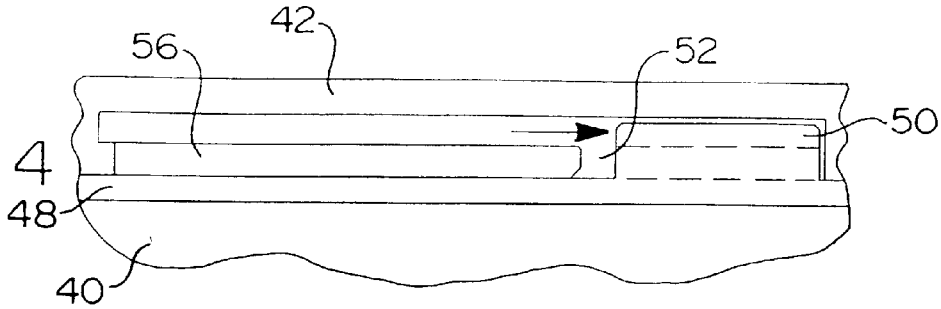
FIG. 4 is a detailed view taken along line 4—4 of FIG. 1 illustrating the insertion of the locking tab into the slot of the locking ring according to the principles of the present invention.

With reference to the accompanying drawings, a dumbbell assembly 10 of the present invention will now be described. The dumbbell assembly 10 includes a base weight member 12 including a body portion 14 defining a central opening 16 extending therethrough and including a handle 18 which extends across the opening 16 in the body portion 14. According to a preferred embodiment, the body portion 14 is ring shaped. A first weight ring assembly 20 is removably mounted to the base weight member 12. A second weight ring assembly 22 is adapted to be removably mounted to the first weight ring 20. A third weight ring assembly 24 is adapted to be removably mounted to the second weight ring assembly 22.

As mentioned above, the body portion 14 of the base weight member 12 is preferably ring shaped. As best shown in the cross-sectional view of FIG. 7, the body portion 14 of the base weight member 12 includes an outer perimeter surface 28 with a pair of angularly disposed edge portions 30, 32. The angularly disposed edge portions 30, 32 extend radially inward. It should also be noted that the inner perimeter surface of the body portion 14 is also provided with angularly disposed edge portions 34, 36 which extend radially outward. The angularly disposed edge portions 34, 36, which are disposed on the inner perimeter surface of the body portion 14 allow for easier access of a user's hand and helps to avoid interference with a user's wrist or forearm while the dumbbell assembly 10 is in use. Additionally, the angularly disposed edge portions 34, 36 allow for a reduction of the inner diameter opening of the handle 18, hence reducing the overall size of the dumbbell assembly 10 and hence, also reduces the torque moments over a standard cylindrical weight.

Figure 11:
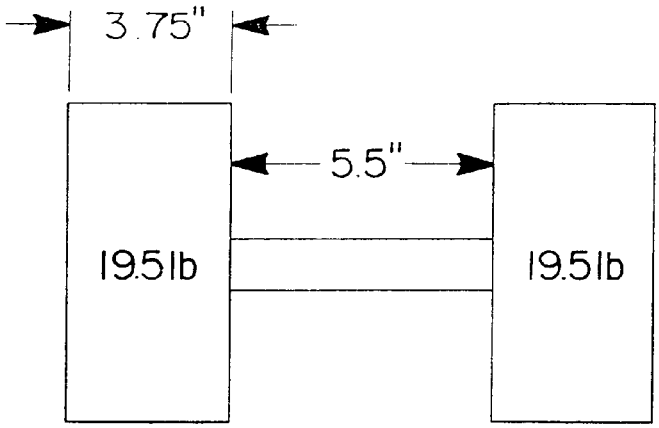
FIG. 11 is a schematic view of a standard 40 pound dumbbell for purposes of illustrating the moment forces.
Figure 12:
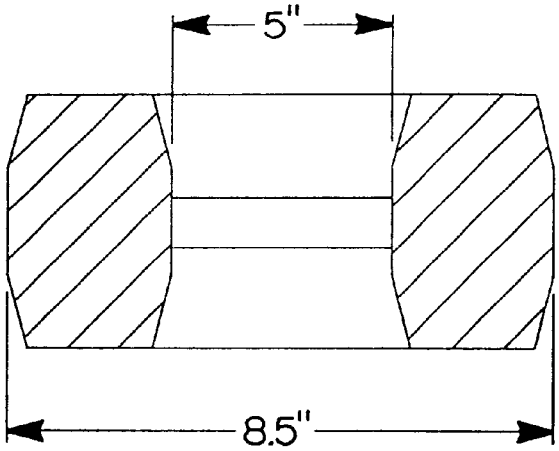
FIG. 12 is a cross sectional view of a 40 pound dumbbell having angled interior edges according to the present invention for purposes of illustrating the moment forces.
Figure 13:
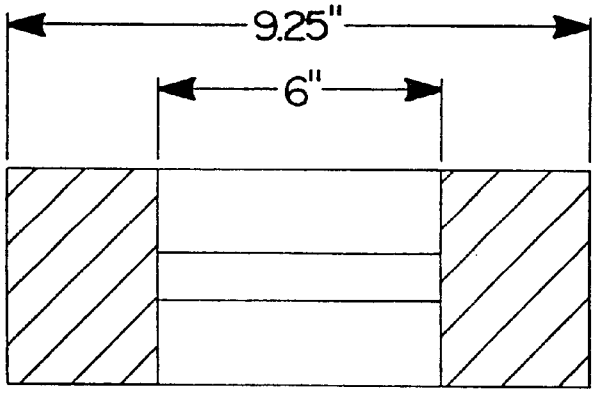
FIG. 13 is a cross sectional view of a ring shaped 40 pound dumbbell for purposes of illustrating the moment forces.

A standard dumbbell free weight comprised of two equal weights, typically hexagonal in shape, attached and separated by a cylindrical handle 5.0 to 5.5 inches long. If a fulcrum is placed at the center of the handle, then the dumbbell is balanced like a see-saw and equal and opposite torques, i.e. moment x weight, are applied at both ends of the dumbbell. These torques for a typical 40-lb. weight are 90.2 inch-lbs. (see FIG. 11 and Equation [1] below). If the same 40 lb. free weight is made with a cylindrical configuration which includes angled edges within the gripping opening, then the left and right side torques calculate to be 32 in-lbs. (see FIG. 12 and Equation [2] below). That is approximately 35% of a standard dumbbell. If on the other hand the cylindrical 40 lb. free weight is made from a cylinder of equal height with no angled edges, then the torques at the left and right hand sides calculate to be 37 in-lbs. (see FIG. 13 and Equation [3] below). That is 41% of a standard dumbbell but 15% greater than the cylindrical weight with angled edges within the gripping opening. The equations for each of the above calculations is shown below.

$$\text{torque}=19.5\times(5.5/12+3.75/2)=90 \text{ inch-lbs.} \quad [1]$$

$$\text{torque}=39/4\times3.375=32.1 \text{ inch-lbs} \quad [2]$$

$$\text{torque}=39/4\times3.8125=37.2 \text{ inch-lbs.} \quad [3]$$

Figure 5:
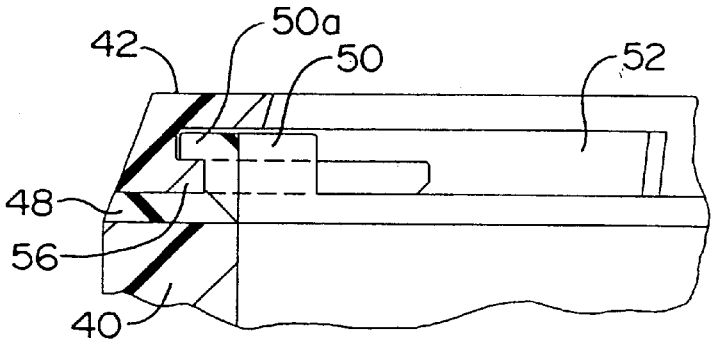
FIG. 5 is a cross-sectional view taken along line 5—5 of FIG. 1 illustrating the locking tab engaged with the slot of the lock ring according to the principles of the present invention.

The base weight member 12 can be nested with a plurality of weight rings such as weight ring assemblies 20, 22, 24. The first weight ring assembly 20 includes first weight ring 40 and first lock ring 42. The first weight ring 40 includes an inner surface 44 with an angularly disposed edge portion 46 which extends radially inward and corresponds with the angularly disposed edge portion 30 of the base weight member 12. The first weight ring 40 also includes a mounting ring 48 fixedly attached to a body portion of the weight ring 40. The mounting ring 48 includes a plurality of mating portion 50 in the form of locking tabs. The lock ring 42 includes a plurality of corresponding mating portions in the form of slots 52. The locking tabs 50 extend vertically upward from the mounting ring 48 and have an uppermost portion 50*a* which extend radially outward as best shown in FIGS. 5, 7, and 9. The slots 52 disposed in the lock ring 42 include a first recess portion 54 which is adapted to receive the radially outward extending portion 50*a* of the tab 50. The slot 52 also includes a flange portion 56 which, upon rotation of the lock ring 42 relative to the weight ring 40, receives the radially outwardly extending portion 50*a* of the locking tabs 50 as shown in FIG. 5 in order to engage the lock ring 42 to the first weight ring 40.

The first weight ring 40 also includes an outer perimeter surface 60 with an angularly disposed lower edge portion 62. The lock ring 42 includes an angularly disposed outer surface 63 and an angularly disposed inner surface 64 which engages the upper angularly disposed edge portion 32 of the base weight member 14. The angularly disposed edge portions 30, 32 of the base weight and the angularly disposed lower edge portions of the weight rings and the angularly disposed surfaces of the lock ring are preferably greater than approximately 7 degrees to avoid locking or wedging of the elements together. The larger the angle, the easier the elements go together and come apart. An angle of 20 degrees has been found to effectively satisfy manufacturing anti-locking characteristics.

The second and third weight ring assemblies 22, 24 are identical in design to the first weight ring assembly 20 but are simply larger in size such that the first weight ring assembly can be nested inside the second weight ring assembly and the second weight ring assembly 22 can be nested radially inward of the third weight ring assembly 24. Specifically, the second weight ring assembly 22 includes a second weight ring 70 and a second lock ring 72 and the third weight ring assembly 24 includes a third weight ring 74 and a third lock ring 76. Each of the weight ring assemblies 20, 22, 24 is designed with a sufficient tolerance to allow mating with one another to prevent locking.

The second and third weight rings 70, 74 each include a mounting ring 48 with tabs 50 as described above with respect to the first weight ring 40. The mounting rings 48 are mounted to the body of the first, second, and third weight rings 40, 70, 74 by screws or by other fastening techniques such as adhesives. The mounting rings 48 are preferably made of injection molded plastic while the body portion of the first, second, and third weight rings 40, 70, 74 are preferably made of case metal, although other materials exhibiting the desired weight characteristics can also be utilized. The second and third lock rings 72, 76 are also provided with slots 52 similar to the slots 52 provided in the first lock ring 42. The first, second, and third lock rings 42, 72, and 76 are preferably made of a plastic material. The use of a combination of materials as discussed above allows for several advantages. Since the plastic components can be made with high precision and the cast metal components can be made at low cost, the assembly as a whole can be manufactured at low cost while the use of the plastic components (mounting rings and lock rings) allows the assembly to be manufactured with high tolerance so as to have a refined operation and appearance.

In operation, the dumbbell assembly 10, according to the principles of the present invention, is laid out in the manner shown in FIG. 1. As is well understood, a pair of dumbbell assemblies 10 is often used during a workout. Initially, it should be noted that the base weight members 12 can be provided with a selected amount of weight such as, for example, 15 pounds or 20 pounds. Then, each of the weight ring assemblies 20, 22, 24 can weigh, for example, 10 pounds so that the base weight member 12 used alone can provide, for example, a 15-pound or 20-pound weight while the addition of the first weight ring assembly 20 will allow the use of a 25-pound and 30-pound dumbbell, and the addition of the first and second weight ring assemblies 20, 22 will provide a 35-pound and 40-pound dumbbell and the use of the first, second, and third weight ring assemblies 20, 22 and 24 would provide a 45-pound and 50-pound dumbbell. The base weight members of 10, 15 or 20 pounds are designed so that their outer perimeters are identical and can readily accept the weight ring assemblies 20, 22 and 24.

By selectively disengaging the third lock ring 76 from the third weight ring 74, the dumbbell assembly 10 can be picked up by handle 18 and the first and second weight ring assemblies 20, 22 would be picked up along with the base weight member 12 while the third weight ring 74 would remain on the floor. Similarly, removal of the second and third lock ring 72, 76 from the second and third weight rings 70, 74 by rotation of the lock rings in the direction of arrow B would allow the first weight ring assembly 20 to be maintained with the base weight member 12 but freed from the second and third weight ring assemblies 22, 24. In addition, removal of all of the lock rings 42, 72, 76 would allow the base weight members 12 to be utilized alone in order to provide the smallest increment of weight for the dumbbell assembly 10.

Figure 6:
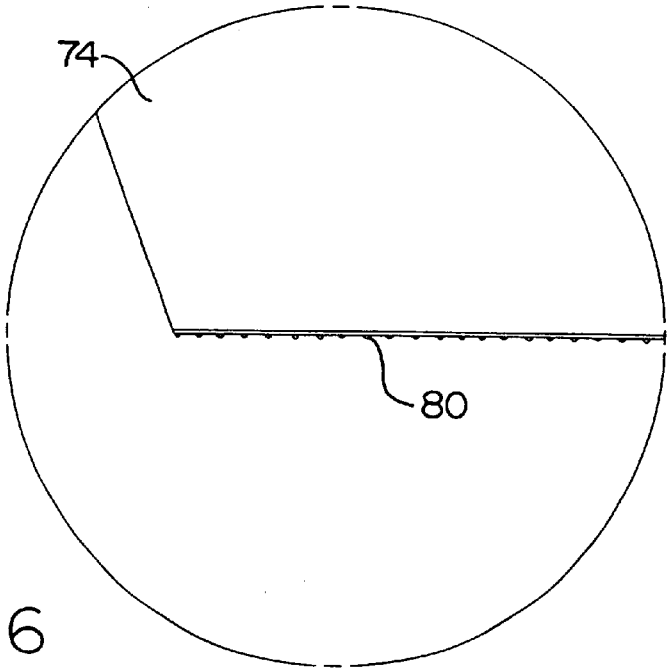
FIG. 6 is a detailed view of the circled area 6 of FIG. 2 illustrating the serrations on the face surface of the dumbbell system of the present invention.

In order to facilitate holding the first, second, or third weight rings 40, 70, 74 from rotating with the rotation of the corresponding lock ring 42, 72, 76, the bottom face surfaces of the first, second, and third weight rings 40, 70, 74 can be provided with a serrated surface 80 such as shown in FIG. 6. The serrations would act to provide a frictional contact with the floor to prevent the weight rings from rotating when the lock rings are engaged or disengaged. Alternatively, the bottom surfaces of the weight rings 40, 70, 74 can also be provided with a rubberized coating which would provide additional friction between the floor or other surface to provide means for preventing rotation of the weight rings when the lock rings are being rotated for engagement or disengagement from the weight rings. Additionally, a rubber mat 82 may also be utilized as shown in FIG. 3 for providing this function. The first, second, and third lock rings 42, 72, and 76 can also be provided with a plurality of dimples 84 on an upper surface thereof in order to facilitate a user's gripping the lock rings for rotation relative to the weight rings.

It should be noted that although the dumbbell assembly 10 of the present invention has been illustrated as a ring-shaped design, other shapes may be utilized without departing from the spirit and scope of the present invention. In particular, oval, square, or rectangular shaped members could be utilized in a similar nested fashion with different types of mating portions being required on the locking members for securing the additional weights to the base weight member. In addition, the above example was illustrated with three weight ring assemblies being added. It should be understood that any number of weight ring assemblies can be utilized so long as the size of the dumbbell system does not become too large and cumbersome for the user.

In order to provide even greater versatility with the dumbbell system of the present invention, a universal component may also be introduced to a single master member in order to provide for the addition of, for example, five-pound increments. This can be accomplished, for example, by providing a single heavier weighted lock ring to replace the innermost lock ring 42 which is lighter weight and made of plastic. The heavier weighted lock ring can be made of, or filled with, a heavier material then the lock ring 42. Alternatively, other methods of mounting an additional weight may be utilized.

Figure 10:
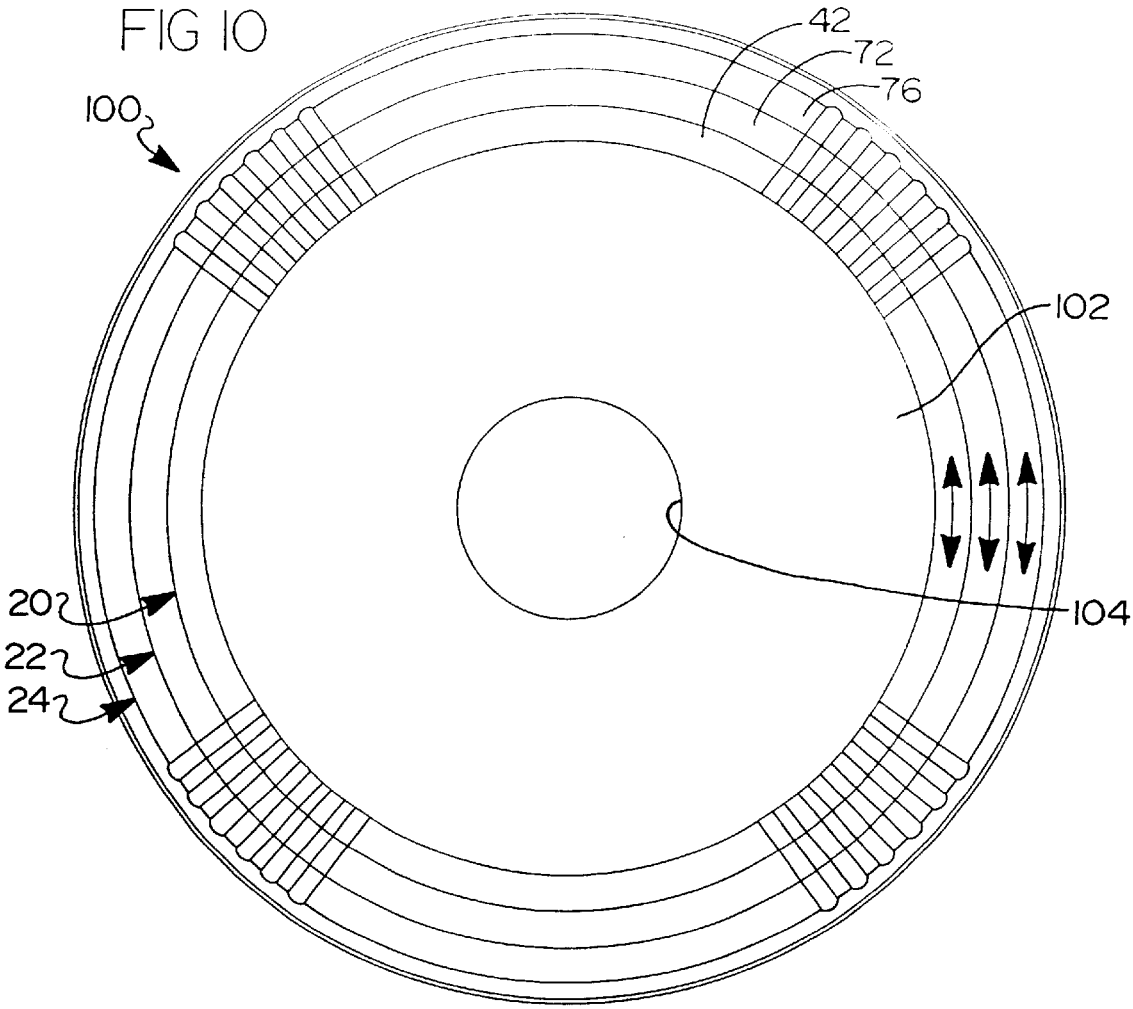
FIG. 10 is a top view of a weight disk system according to the principles of the present invention.

The nested arrangement of the weight system of the present invention can also be utilized for providing variable weight disks 100 (shown in FIG. 10) for use with a standard barbell in the same manner that conventional weight disks are utilized. In this arrangement, the base weight member 102 is provided with a smaller central hole 104 which is adapted to receive a barbell therethrough. The first, second, and third weight ring assemblies 20, 22, 24 are removably mounted to the base weight member 102 in the same manner as described above with respect to the dumbbell system 10. Thus, the disk weight assembly 100, provides a compact design to provide several increments of weight in the space of a single disk.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dumbbell system, comprising:

a base weight member including a ring shaped body and a handle extending across an opening in said ring shaped body; and a weight ring adapted to be removably mounted to said base weight member, wherein said weight ring has a central hole adapted to receive the base weight member, said central hole having a wider diameter at an upper side of said weight ring and a narrower diameter at a lower side of said weight ring; and further comprising a locking mechanism accessible from said upper side of said weight ring.

2. The dumbbell system according to claim 1, further comprising a lock-ring which is engagable with said weight ring to securely mount said weight ring to said base weight member.

3. The dumbbell system according to claim 2, wherein one of said weight ring and said lock ring includes a first mating portion and the other of said weight ring and said lock ring includes a second mating portion which is adapted to be engaged with said first mating portion for securing said weight ring and said lock ring together.

4. The dumbbell system according to claim 3, wherein said first and second mating portions are engaged with one another by rotating said lock ring relative to said weight ring.

5. The dumbbell system according to claim 4, wherein said base weight member has an outer perimeter surface with a pair of angularly disposed edge portions.

6. The dumbbell system according to claim 5, wherein said weight ring includes an inner surface with at least one angularly disposed edge portion which engages one of said pair of angularly disposed edge portions of said base weight member.

7. The dumbbell system according to claim 6, wherein said lock ring includes an angularly disposed inner surface which engages the other of said pair of angularly disposed edge portions of said base weight member.

8. The dumbbell system according to claim 3, wherein said first mating portion is a locking tab and said second mating portion is a slot which is adapted to receive said locking tab.

9. The dumbbell system according to claim 2, further comprising a second weight ring adapted to be removably mounted to said weight ring.

10. The dumbbell system according to claim 9, further comprising a third weight ring adapted to be removably mounted to said second weight ring.

11. The dumbbell system according to claim 1, wherein said weight ring is adapted to be removably mounted to an outer surface of said base weight member.

12. The dumbbell system according to claim 11, further comprising a second weight ring adapted to be removably mounted to said weight ring.

13. The dumbbell system according to claim 12, further comprising a third weight ring adapted to be removably mounted to said second weight ring.

14. The dumbbell system according to claim 1, wherein said base weight member has an outer perimeter surface with a pair of angularly disposed edge portions.

15. The dumbbell system according to claim 14, wherein said weight ring includes an inner surface with at least one angularly disposed edge portion which engages one of said pair of angularly disposed edge portions of said base weight member.

16. The dumbbell system according to claim 1, further comprising a second weight ring adapted to be removably mounted to said weight ring.

17. The dumbbell system according to claim 16, further comprising a third weight ring adapted to be removably mounted to said second weight ring.

18. The dumbbell system according to claim 1, wherein said weight ring includes a serrated face surface.

19. The dumbbell system according to claim 2, wherein said lock ring includes a face surface having a plurality of dimples thereon.

20. The dumbbell system according to claim 2, wherein said weight ring includes a body portion and a mounting ring fixedly attached to said body portion, said mounting ring including a first mating portion and said lock ring including a second mating portion which is adapted to be engaged with said first mating portion for securing said weight ring and said lock ring together.

21. A dumbbell system, comprising:

a base weight member including a body portion defining a central opening therethrough and a handle extending across said opening in said body portion; and a second weight member adapted to be removably mounted to an outer surface of said body portion of said base weight member, wherein said second weight member has a central hole adapted to receive the base weight member, said central hole having a wider diameter at an upper side of said weight member and a narrower diameter at a lower side of said second weight member; and further comprising a locking mechanism accessible from said upper side of said second weight member.

22. The dumbbell system according to claim 21, wherein said body portion of said base weight member and said second weight member are ring shaped.

23. The dumbbell system according to claim 21, further comprising a locking member which is engagable with said second weight member to securely mount said second weight member to said base weight member.

24. The dumbbell system according to claim 23, wherein one of said second weight member and said locking member includes a first mating portion and the other of said second weight member and said locking member includes a second mating portion which is adapted to be engaged with said first mating portion for securing said second weight member and said locking member together.

25. The dumbbell system according to claim 21, wherein said body portion of said base weight member has an outer perimeter surface with a pair of angularly disposed edge portions.

26. The dumbbell system according to claim 25, wherein said second weight member includes an inner surface with at least one angularly disposed edge portion which engages one of said pair of angularly disposed edge portions of said base weight member.

27. The dumbbell system according to claim 21, further comprising a third weight member adapted to be removably mounted to said second weight member.

28. The dumbbell system according to claim 27, further comprising a fourth weight member adapted to be removably mounted to said third weight member.

29. A dumbbell system comprising:

a base weight member including a ring shaped body and a handle extending across an opening in said ring shaped body;

a weight ring adapted to be removably mounted to said base weight member; and a locking device rotatably engageable with said weight ring to securely mount said weight ring to said base weight member.

* * * * *